US010451309B2

(12) United States Patent
Nyander et al.

(10) Patent No.: US 10,451,309 B2
(45) Date of Patent: Oct. 22, 2019

(54) HEATER AND A HEAT EXCHANGER INSTALLATION

(71) Applicant: ALFA LAVAL CORPORATE AB, Lund (SE)

(72) Inventors: Anders Nyander, Staffanstorp (SE); Martin Ross, Sjöbo (SE)

(73) Assignee: ALFA LAVAL CORPORATE AB, Lund (SE)

( * ) Notice: Subject to any disclaimer, the term of this patent is extended or adjusted under 35 U.S.C. 154(b) by 169 days.

(21) Appl. No.: 15/319,638

(22) PCT Filed: May 5, 2015

(86) PCT No.: PCT/EP2015/059791
§ 371 (c)(1),
(2) Date: Dec. 19, 2016

(87) PCT Pub. No.: WO2015/193023
PCT Pub. Date: Dec. 23, 2015

(65) Prior Publication Data

US 2017/0122620 A1 May 4, 2017

(30) Foreign Application Priority Data

Jun. 17, 2014 (EP) ..... 14172832

(51) Int. Cl.
*F24H 1/10* (2006.01)
*F24H 1/12* (2006.01)
(Continued)

(52) U.S. Cl.
CPC ..... *F24H 1/121* (2013.01); *F24H 1/38* (2013.01); *F24H 9/0015* (2013.01); *F24H 9/146* (2013.01);
(Continued)

(58) Field of Classification Search
CPC ..... F24H 1/121; F24H 1/38; F24H 9/0015; F24H 9/146; F24H 9/1818; F28D 1/0333; H05B 2203/02; H05B 3/24; H05B 3/262
(Continued)

(56) References Cited

U.S. PATENT DOCUMENTS 1,820,458 A * 8/1931 Jenkins ..... F24H 1/121 392/481
5,727,118 A 3/1998 Roussel et al.
(Continued)

FOREIGN PATENT DOCUMENTS

CN 1194364 A 9/1998
CN 2578717 Y 10/2003
(Continued)

OTHER PUBLICATIONS

International Search Report (PCT/ISA/210) dated Aug. 19, 2015, by the European Patent Office as the International Searching Authority for International Application No. PCT/EP2015/059791.
(Continued)

*Primary Examiner* — Sang Y Paik
(74) *Attorney, Agent, or Firm* — Buchanan Ingersoll & Rooney PC

(57) ABSTRACT

A heater comprises an inlet for a medium to be heated, an outlet for the medium, and at least two cassettes. Each cassette comprising a first plate comprising a first main surface and a second plate comprising a second main surface. The first and second plates are attached to each other and enclose a respective flow channel for the medium. The cassettes are arranged beside each other with a space between the cassettes for an electric heating element. The electric heating element abuts the first main surface of one of the cassettes and the second main surface of the adjacent cassette. The heater comprises two distance members
(Continued)

extending between the one cassette and the adjacent cassette. The distance members define the space.

19 Claims, 5 Drawing Sheets

(51) Int. Cl.

| | |
|---|---|
| ***F24H 9/18*** | (2006.01) |
| ***F28D 1/03*** | (2006.01) |
| ***F24H 1/38*** | (2006.01) |
| ***F24H 9/00*** | (2006.01) |
| ***F24H 9/14*** | (2006.01) |
| ***H05B 3/24*** | (2006.01) |
| ***H05B 3/26*** | (2006.01) |

(52) U.S. Cl.
CPC ..... *F24H 9/1818* (2013.01); *F28D 1/0333* (2013.01); *H05B 3/24* (2013.01); *H05B 3/262* (2013.01); *H05B 2203/02* (2013.01)

(58) Field of Classification Search
USPC ..... 392/479–490
See application file for complete search history.

(56) References Cited

U.S. PATENT DOCUMENTS

| | | | | |
|---|---|---|---|---|
| 6,318,455 | B1 * | 11/2001 | Nakado | F28D 1/0341 165/153 |
| 6,421,501 | B2 | 7/2002 | Berthou et al. | |
| 8,186,719 | B2 * | 5/2012 | Kume | F28D 1/0341 165/176 |
| 2013/0092744 | A1 | 4/2013 | Kominami et al. | |
| 2013/0287379 | A1 | 10/2013 | Yoshitomi et al. | |

FOREIGN PATENT DOCUMENTS

| | | | |
|---|---|---|---|
| CN | 201100746 | Y | 8/2008 |
| CN | 201293445 | Y | 8/2009 |
| CN | 201561488 | U | 8/2010 |
| CN | 103403467 | A | 11/2013 |
| DE | 10 2010 038 781 | A1 | 2/2012 |
| EP | 0 586 677 | B1 | 2/1997 |
| EP | 0 857 922 | B1 | 4/2003 |
| EP | 2 660 531 | A1 | 11/2013 |
| JP | 2002-283835 | A | 10/2002 |
| JP | 2005-090868 | A | 4/2005 |
| JP | 2005-142305 | A | 6/2005 |
| JP | 2008-166423 | A | 7/2008 |
| JP | 2012-096779 | A | 5/2012 |
| JP | 2012-141096 | A | 7/2012 |
| JP | 2012-154579 | A | 8/2012 |
| JP | 2014-066409 | A | 4/2014 |
| WO | WO 2012/101273 | A1 | 8/2012 |

OTHER PUBLICATIONS

Written Opinion (PCT/ISA/237) dated Aug. 19, 2015, by the European Patent Office as the International Searching Authority for International Application No. PCT/EP2015/059791.

Office Action (Notice of Reasons for Rejection) dated Oct. 30, 2017, by the Japanese Patent Office in corresponding Japanese Patent Application No. 2016-573945, and an English Translation of the Office Action. (14 pages).

An English Translation of the First Office Action dated Dec. 21, 2018, by the State Intellectual Property Office of People's Republic of China in corresponding Chinese Patent Application 201580032808.0. (14 pages).

* cited by examiner

HEATER AND A HEAT EXCHANGER INSTALLATION

TECHNICAL FIELD OF THE INVENTION

The present invention refers to a heater according to the preamble of claim 1. In particular, the present invention refers to a separate heater which may be used separately or be configured to be connected to a heat exchanger.

For instance, the present invention refers to a heater configured to be connected to an outlet port of a plate heat exchanger for providing additional heat to the medium discharged from the plate heat exchanger through the outlet port when there is a need for a higher temperature of the medium, or to an inlet port of a plate heat exchanger for providing additional heat to the medium to be supplied to the plate heat exchanger through the inlet port when there is a need for preheating of the medium.

The present invention also refers to a heat exchanger installation comprising a heat exchanger and a heater.

BACKGROUND OF THE INVENTION AND PRIOR ART

In some heat pump installations, it is known to arrange a supplementary electric heater in order to provide an additional boost of the performance of the installation under specific conditions. Such a supplementary heater may for instance permit the heat pump of the installation to operate at lower ambient temperatures. Moreover, the supplementary heater may permit an increase of the temperature to such a level that bacteria and other microorganisms may be removed from hot tap water.

Such existing supplementary heaters are suffering from different disadvantages of being space consuming, requiring complex connections and installation, lacking modularity and flexibility, and requiring many welds increasing the risk for leakage.

WO 2012/101273 discloses a heater to be connected to a plate heat exchanger having inlet and outlet ports. The heater comprises two plate pairs with two inlets for a medium to be heated and two outlets for the medium. Each plate pair comprises a first plate comprising a first main surface and a second plate comprising a second main surface. The first plate and the second plate are attached to each other and enclose a respective flow channel for the medium between the first and second plates. The plate pairs are arranged beside each other with a space between the plate pairs. An electric heating element is provided in the space between the plate pairs. Each plate pair defines a flow channel. The flow channels are not directly connected to each other but via external pipes.

U.S. Pat. No. 6,421,501 discloses another heater to be connected to a plate heat exchanger having an inlet port and an outlet port. The heater comprises a plurality of chambers, each comprising a first plate and a second plate spaced apart by a spacer, which together form a flow channel for a medium. The first and second plates form a respective electrode for heating the medium.

SUMMARY OF THE INVENTION

The object of the present invention is to provide a heater of the kind initially defined which overcomes the disadvantages mentioned above and which permits a high modularity and flexibility. In particular, it is aimed at an easy and flexible connection to a heat exchanger to meet various demands.

This object is achieved by the heater initially defined, which is characterized in that the heater comprises two distance members extending between said one cassette and said adjacent cassette, wherein the distance members define said space.

By means of such distance members, the cassettes may easily be mounted to each other. The distance members will define or create the space between the cassettes, which thus has a well-defined dimension permitting the mounting of the electric heating element in the space. The number of cassettes may be adapted to various needs of heating. The chosen number of such cassettes may then be attached to each other with an electric heating element in each space between the cassettes.

The space between the cassettes may be open to the surrounding environment.

The heater according to the invention may thus comprise two, three, four, five or even more cassettes with an electric heating element in each space between the cassettes.

Such a heater is suitable for being connected to an inlet or outlet port of a heat exchanger, such as a plate heat exchanger, in a heat exchanger installation.

In order to further improve the heat transfer from the electric heating element to the medium, the electric heating element may be permanently joined to the first main surface of said one cassette and to the second main surface of said adjacent cassette, for instance by means of brazing, bonding, welding or gluing.

According to a further embodiment, the electric heating element comprises a metal tube which may abut, and possibly be permanently joined to, the first main surface of said one cassette and to the second main surface of said adjacent cassette. In such a way, an efficient heat transfer from the electric heating element to the medium is secured.

The heater may be configured to be used in a vertical orientation so that the flow channels extend vertically. The heater has further advantages in such an orientation, since any possible air pocket in flow channels may then easily be located above the electric heating element. The electric heating element will thus adjoin the medium creating an appropriate heat balance of the heater. The air in the air pocket will not be directly heated, which reduces or eliminates the risk for overheating of the electric heating element and/or for an overpressure in the flow channels. Since the sensibility to air pockets is reduced, no venting valve is needed.

According to an embodiment of the invention, each cassette comprises at least two openings permitting a flow of the medium from the flow channel of said one cassette to the flow channel of said adjacent cassette. Cassettes with two openings are suitable for serial flow through the flow channels.

According to a further embodiment of the invention, each first plate of each cassette comprises at least one opening. Furthermore, each second plate of each cassette may comprise at least one opening. Possibly, the second plate of an outermost cassette of the heater may lack openings.

The cassettes may also comprise three or four openings for the flow communication in order to permit parallel flow through the flow channels.

Moreover, the heater may comprise a combination of cassettes with two and three opening, with three and four openings, or with two and four openings.

According to a further embodiment of the invention, at least one of the openings of said one cassette is provided opposite to one of the openings of said adjacent cassette, wherein the distance members surround said openings and permit said flow through said openings. The medium may thus flow directly from one flow channel to an adjacent flow channel without any external piping. In particular, at least one of the openings of the second plate of said one cassette is adjoining at least one of the openings of the first plate of said adjacent cassette to permit the fluid to pass from the flow channel of said one cassette to the flow channel of said adjacent cassette.

According to a further embodiment of the invention, each distance member comprises a ring defining two planar joining areas abutting the second main surface of said one cassette and the first main surface of said adjacent cassette. Such planar joining areas ensure a tight and reliable attachment of the ring to the first and second main surfaces. Each ring may then surround a respective opening, in case an opening is to be provided at that position. The planar joining area then ensures a tight seal for the medium flowing through the opening.

According to a further embodiment of the invention, each distance member comprises at least one projection extending from the second main surface of said one cassette and/or from the first main surface of said adjacent cassette. Each projection thus defines the space, or the distance between the main surfaces.

According to a further embodiment of the invention, each distance member comprises only one projection extending from the second main surface or from the first main surface, wherein each projection comprises a planar joining area abutting the first main surface or the second main surface of an adjacent cassette. Thus, there are at least two projections extending between the main surfaces. The two projections may both be provided on one of the first main surface and the second main surface, whereas the other of the first main surface and the second main surface then may lack projections. The planar joining area of each projection is suitable for joining the two adjacent mains surfaces to each other.

According to a further embodiment of the invention, each distance member comprises a first projection and a second projection, wherein the second plate of said one cassette comprises two second projections, which extend outwardly from the second main surface, and the first plate of said another adjacent cassette comprises two first projections, which extend outwardly from the first main surface, and wherein the first projections of said one cassette are abutting the second projections of said adjacent cassette to define said space.

Advantageously, each first plate of each cassette may comprise at least two first projections extending from the first main surface and each second plate of each cassette may comprise at least two second projections extending from the second main surface. In such a way each first and second plate of each cassette may be identical, wherein each second plate is rotated in relation to the respective first plate.

According to a further embodiment of the invention, each of the first and second projections comprises a planar joining area, wherein the planar joining areas of the second projections of said one cassette are abutting the planar joining areas of the first projections of said adjacent cassette of the heater. Such planar joining areas ensure a tight and reliable attachment of the cassettes to each other.

A tight permanent joint may be achieved around the openings along the planar joint areas of the different embodiments discussed above to permit a secure attachment of the cassettes to each other and a secure communication channel between the flow channels of the cassettes.

Advantageously, the inlet and the outlet may extend through such an opening of a respective planar joining area of such a projection. An inlet pipe and an outlet pipe may be securely attached to the respective planar joining area of such a projection. Alternatively, the inlet pipe and the outlet pipe may be joined directly to the first main surface or the second main surface around a respective opening.

According to a further embodiment of the invention, the inlet is in flow communication with the flow channels of the cassettes, and the outlet is in flow communication with the flow channels of the cassettes, so that the heater permits the medium to flow into the inlet, through the flow channels and out through the outlet.

According to a further embodiment of the invention, the first main surface and the second main surface are substantially planar. Such planar surfaces improves the heat conduction from the electric heating element to the medium. The first projections may extend from such a planar first main surface. The second projections may extend from such a planar second main surface.

According to a further embodiment of the invention, each first plate comprises a first flange extending around the first plate and away from the first main surface, each second plate comprises a second flange extending around the second plate and away from the second main surface, and the first plate and the second plate are joined to each other by means of a joint extending along an outer edge of the first flange and an outer edge of the second flange. In such a way, the first and second plates may be securely joined to each other by a permanent joint obtained by for instance brazing, bonding, welding or gluing. Advantageously, the outer edge of the first flange and the outer edge of the second flange may provide a respective edge surface being parallel with a common extension plane and being joined to each other to form said permanent joint.

According to a further embodiment of the invention, a connecting member is provided in the flow channel of each cassette and connects the first main surface to the second main surface. Such a connecting member will improve the strength of the cassette. Moreover, such a connecting member will influence the flow of the medium, and increase the turbulence and thus the efficiency of the heat transfer from the electric heating element to the medium.

According to a further embodiment of the invention, the connecting member comprises a number of depressions extending inwardly from at least one of the first main surface and the second main surface.

According to a further embodiment of the invention, at least one depression extending from the first main surface abuts a depression extending from the second main surface.

According to a further embodiment of the invention, the connecting member comprises a corrugated sheet arranged in the flow channel between the first plate and the second plate.

According to a further embodiment of the invention, the electric heating element comprises an electrical resistance wire.

According to a further embodiment of the invention, the electrical resistance wire is embedded in a ceramic sleeve, which may be provided in the above mentioned metal tube, for instance of stainless steel.

Such a metal tube may be permanently joined to the adjoining cassettes by for instance brazing, bonding, welding or gluing. In such a way an integrated heater is obtained.

The object mentioned above is also achieved by the initially defined heat exchanger installation comprising a heat exchanger, for instance a plate heat exchanger, and a heater as mentioned above.

The heat exchanger may have an inlet port and an outlet port for the medium. Advantageously, the inlet of the heater may be connected to the outlet port of the heat exchanger, or the outlet of the heater may be connected the inlet port of the heat exchanger.

BRIEF DESCRIPTION OF THE DRAWINGS

The present invention is now to be explained more closely through a description of preferred embodiments and with reference to the drawings attached hereto.

DETAILED DESCRIPTION OF VARIOUS EMBODIMENTS OF THE INVENTION

A first embodiment of the heater is disclosed in FIGS. 1-4. The heater comprises an inlet 1 for a medium to be heated and an outlet 2 for the medium that has been heated. An inlet pipe 3 is provided upstream the inlet 1. An outlet pipe 4 is provided downstream the outlet 2.

Figure 1:
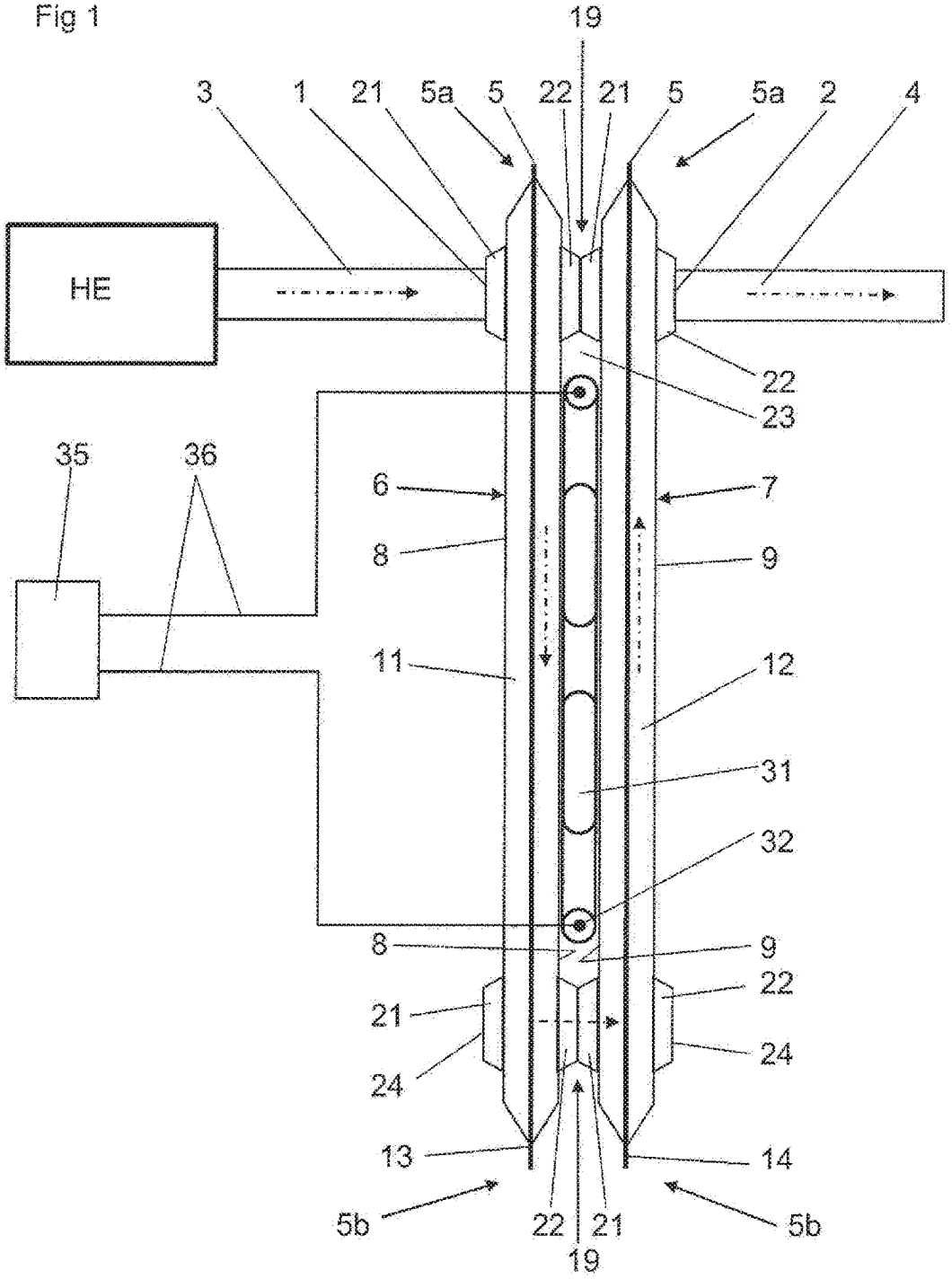
FIG. 1 discloses a side view of a heater according to a first embodiment of the invention.
Figure 2:
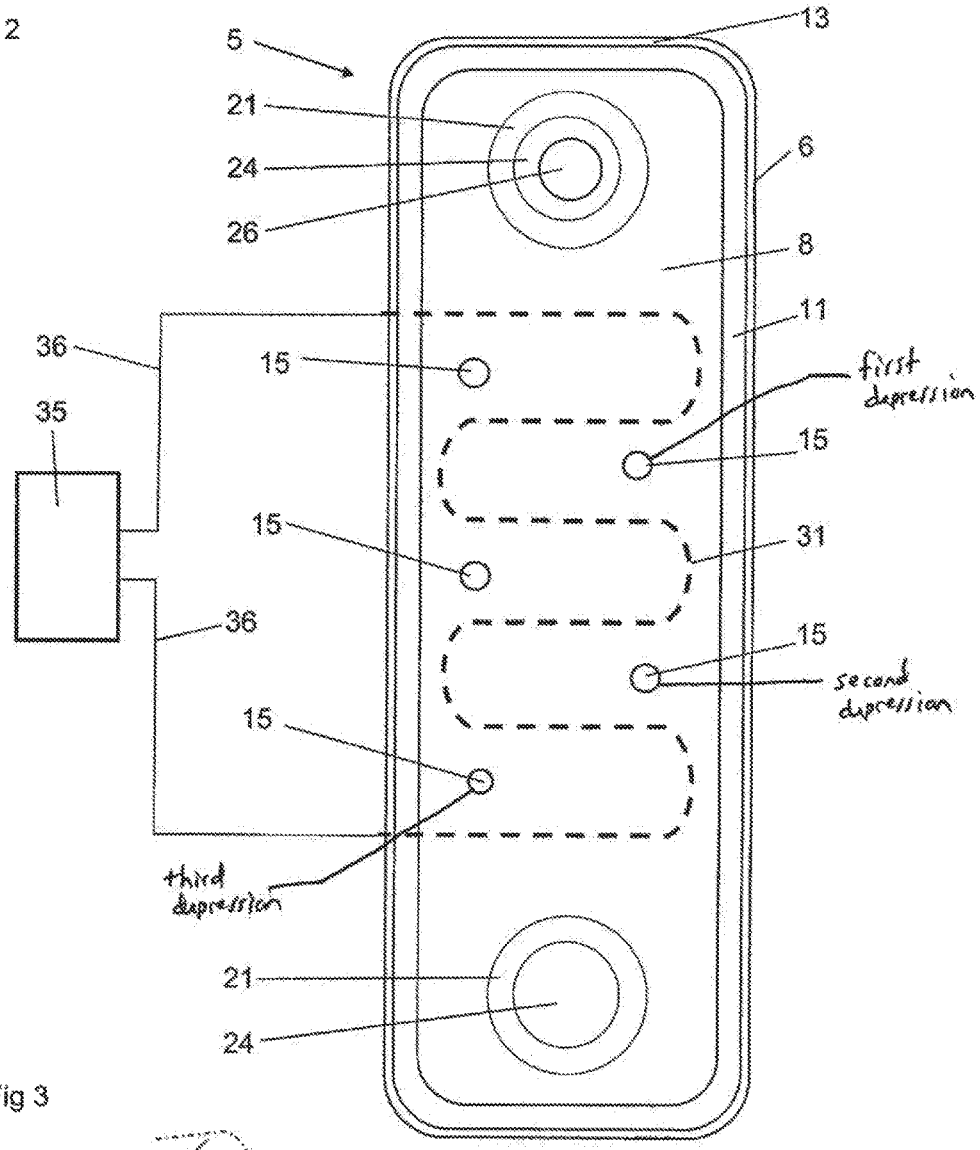
FIG. 2 discloses front view of the heater in FIG. 1.

The heater may be a part of an installation comprising a heat exchanger HE, schematically indicated in FIG. 1.

The inlet pipe 3 and/or the outlet pipe 4 may be parts of the heater or parts of the installation together with which the heater is to be used. The heater is then attached to the inlet pipe 3 and/or the outlet pipe 4 in any suitable manner, for instance by brazing, bonding, welding or gluing to form a permanent joint.

The heater according to the first embodiment comprises two cassettes 5. Each cassette 5 comprises a first plate 6 and a second plate 7, see FIG. 4. The first plate 6 comprises a first main surface 8. The second plate 7 comprises a second main surface 9.

Each cassette 5 has a first end 5*a* and an opposite second end 5*b*. In FIG. 1, the first end 5*a* is an upper end and the second end 5*b* a lower end. The heater may of course be used in other orientations, for instance the other way around so that the second end 5*b* forms an upper end and the first end 5*a* forms a lower end. Advantageously, the heater is vertically oriented, as indicated in the figures.

In the first embodiment, the inlet 1 is provided at the first end 5*a* and the outlet 2 is provided at the first end 5*a* but on an opposite side of the heater.

Figure 4:
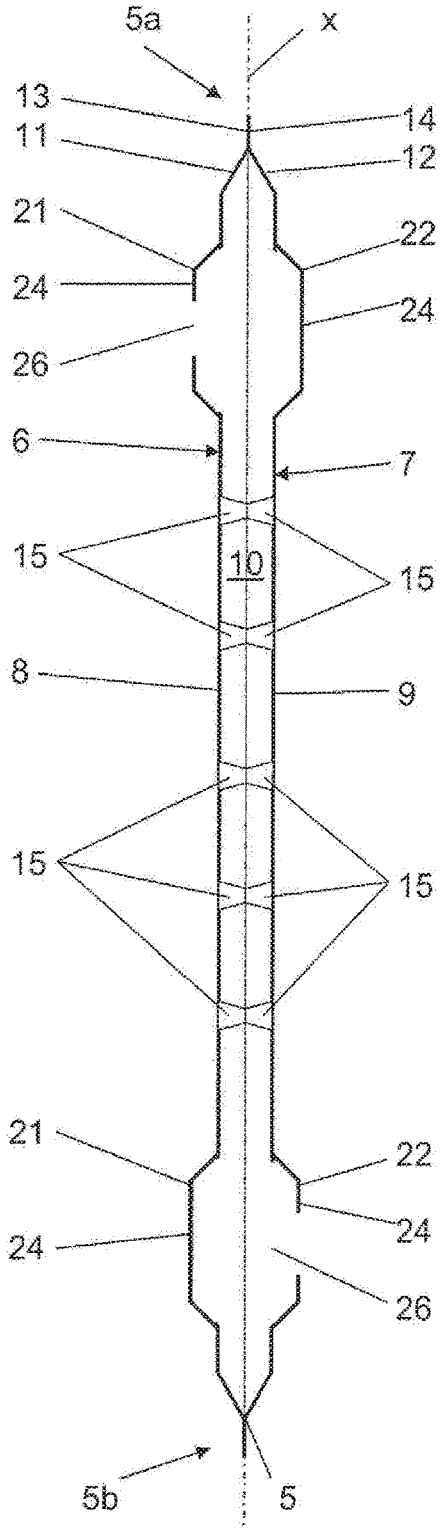
FIG. 4 discloses a side view of a cassette of the heater in FIG. 1.

Both the first main surface 8 and the second main surface 9 are planar, or substantially planar, and extend in parallel with a common extension plane x, see FIG. 4.

The first plate 6 and the second plate 7 are permanently joined to each other and enclose a flow channel 10 for the medium between the first plate 6 and the second plate 7, see FIG. 4.

The first plate 6 comprises a first flange 11 extending around the first plate 6. The first flange 11 extends around and encloses the first main surface 8. The first flange 11 extends away from the first main surface 8, and is thus inclined in relation to the first main surface 8. In the embodiments disclosed the first flange 11 adjoins the first main surface 8.

The second plate 7 comprises a second flange 12 extending around the second plate 7. The second flange 12 extends around and encloses the second main surface 9. The second flange 12 extends away from the second main surface 9, and is thus inclined in relation to the second main surface 9. In the embodiments disclosed, the second flange 12 adjoins the second main surface 9.

The first plate 6 and the second plate 7 are permanently joined to each other by means of a joint extending along an outer edge area 13 of the first flange 11 and an outer edge area 14 of the second flange 12. As can be seen in FIG. 4, the outer edge area 13 of the first flange 11 and the outer edge area 14 of the second flange 12 are parallel with each other and with the common extension plane x. A secure permanent joint may be obtained between the edge areas 13 and 14 by means of brazing, bonding, welding or gluing to form a permanent joint between the first plate 6 and the second plate 7.

In order to improve the strength of the cassette 5, a connecting member is provided in the flow channel 10. The connecting member connects the first main surface 8 to the second main surface 9.

In the first embodiment, the connecting member comprises a plurality of depressions 15 extending inwardly from the first main surface 8 and one or more depressions 15 extending inwardly from the second main surface 9. The depressions 15 extending from the first main surface 8 abut a respective depression 15 extending from the second main surface 9, see FIG. 4.

The depressions 15 are thus formed on and extend inwardly from the planar first and second main surfaces 8 and 9.

The depressions 15 from the first main surface 8 are permanently joined to the depressions 15 from the second main surface 9 by means of brazing, bonding, welding or gluing. Preferably, the permanent joints between the edge areas 13 and 14 are made in the same joining step as the permanent joint of the connecting member, i.e. in the first embodiment as the joint the between the depressions 15.

It is to be noted that depressions 15 may be provided on only one of the main surfaces 8 or 9, and then extend to the inner side of the opposing main surface 8 or 9.

The heater also comprises two distance members 19 extending between one of the cassettes 5 and an adjacent cassette 5. The distance members 19 define a space 23 between the cassettes 5.

In the first embodiment, each distance member 19 comprises a first projection 21 and a second projection 22. More precisely, the first plate 6 of each cassette 5 comprises two first projections 21, which extend outwardly from the first main surface 8, i.e. from the planar, or substantially planar, first main surface 8. One of the first projections 21 is provided at the first end 5*a* and the other first projection 21 at the second end 5*b*.

The second plate 7 of each cassette 6 comprises two second projections 22, which extend outwardly from the second main surface 9, i.e. the planar, or substantially planar, second main surface 9. One of the second projections 22 is provided at the first end 5*a* and the other second projection 22 at the second end 5*b*.

The first projections 21 of one of the two cassettes 5, to the right in FIGS. 1 and 4, are abutting the second projections 22 of the adjacent cassette 5, to the left in FIG. 1. Thanks to the first and second projections 21, 22, said space 23 is defined between the two cassettes 5, see FIG. 1, or between the first and second main surfaces 8 and 9 of adjacent cassettes 5. In particular, the space 23 is formed between the second main surface 9 of the cassette 5 to the left in FIG. 1 and the first main surface 8 of the cassette 5 to the right in FIG. 1.

Each of the first projections 21 and the second projections 22 comprises a planar joining area 24, see FIG. 4. The planar joining areas 24 of the first projections 21 of one of the cassettes 5, to the right in FIG. 1, are abutting the planar joining areas 24 of the second projections 22 of the adjacent cassette 5 to the left in FIG. 1. The cassettes 5 may be permanently joined to each other by joining the abutting planar surfaces 24 of adjacent cassettes 5 to each other, for instance by means of brazing, bonding, welding or gluing.

In the first embodiment, the first projection 21 at the first end 5*a* the cassette 5, to the left in FIG. 1, comprises an opening 26, see FIG. 4, forming the inlet 1 for the medium. In the same way the second projection 22 at the second end 5*b* of the same cassette 5 comprises an opening 26. Correspondingly, the first projection 21 at the second end 5*b* of the adjacent cassette 5 to the right in FIG. 1 comprises an opening 26 which is opposite to the second projection 22 at the second end 5*b* of the cassette 5 to the left to enable flow communication between the two cassettes 5. Furthermore, the second projection 22 at the first end 5*a* of the adjacent cassette 5 to the right also comprises an opening 26 forming the outlet 2 for the medium.

Each of the openings 26 extends through a respective planar joining area 24 as can be seen in FIG. 4.

The remaining projections 21 and 22 of the heater according to the first embodiment are closed.

Consequently, as indicated in FIG. 1, the medium may flow in through the inlet pipe 3 and the inlet 1 of the opening 26 of one of the first projections 21, through the flow channel 10 of the cassette 5 to the left, through the openings 26 of the second projection 22 and the first projection 21 into the adjacent cassette 5, through the flow channel 10 of the adjacent cassette 5 and then out through the opening 26 of the second projection 22 to the outlet 2 and the outlet pipe 4.

The cassettes 5 of the first embodiment are thus arranged to permit serial flow of the medium through the flow channels 10 of the cassettes 5.

The heater also comprises an electric heating element 31 provided in the space 23 between the cassettes 5. The electric heating element 31 abuts the first main surface 8 of one of the cassettes 5 and the second main surface 9 of the adjacent cassette 5.

The electric heating element 31 may be permanently joined to the first main surface 8 of one of the cassettes 5 and to the second main surface 9 of the adjacent cassette 5, for instance by means of brazing, bonding, welding or gluing.

Preferably, the electric heating element 31 may be permanently joined to the first and second main surfaces 8, 9 in the same joining step as the joining of the connecting member, the joining of the edge surfaces 13 and 14, and the joining of the planar joining areas 24 to each other. In such a way, the heater may be joined as a complete unit in one single joining step. The joining enables the achievement an integrated heater.

Figure 3:
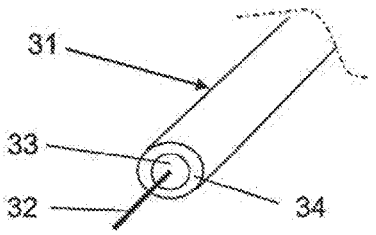
FIG. 3 discloses a perspective view of a part of an electric heating element of the heater in FIG. 1.

The electric heating element 31 comprises an electrical resistance wire 32, see FIG. 3. The electrical resistance wire 32 may be embedded in an insulation, such as a ceramic sleeve 33 of any suitable ceramic material.

The electric heating element 31 comprises a metal tube 34, which surrounds the ceramic sleeve 33 and the electric resistance wire 32. The metal tube 34 forms the outer casing of the electric heating element 31.

The electric heating element 31 may be suitable for being permanently joined to the adjoining first and second main surfaces 8 and 9 by brazing, bonding, welding or gluing as mentioned above.

The metal tube 34 of the electric heating element 31 is, for instance, made of stainless steel. A metal tube 34 is suitable for such permanent joining. However, the electric heating element 31 may alternatively comprise an outer casing of other materials than metal, for instance a ceramic material, which also may be permanently joined to the first and second main surfaces 8 and 9.

As can be seen in FIG. 1, the electric heating element 31 is connected to a current source 35 via the lines 36 in order to provide the electric current for operating the electric heating element 31 at a suitable temperature.

Advantageously, the electric heating element 31 is provided in a central area of the first main surface 8 and the second main surface 9. For instance, the electric heating element 31 may extension between the two distance members 19 as in the embodiments disclosed, see especially FIG. 2. Thus, there are two end regions of the cassettes, which are not located adjacent to the electric heating element 31.

Figure 5:
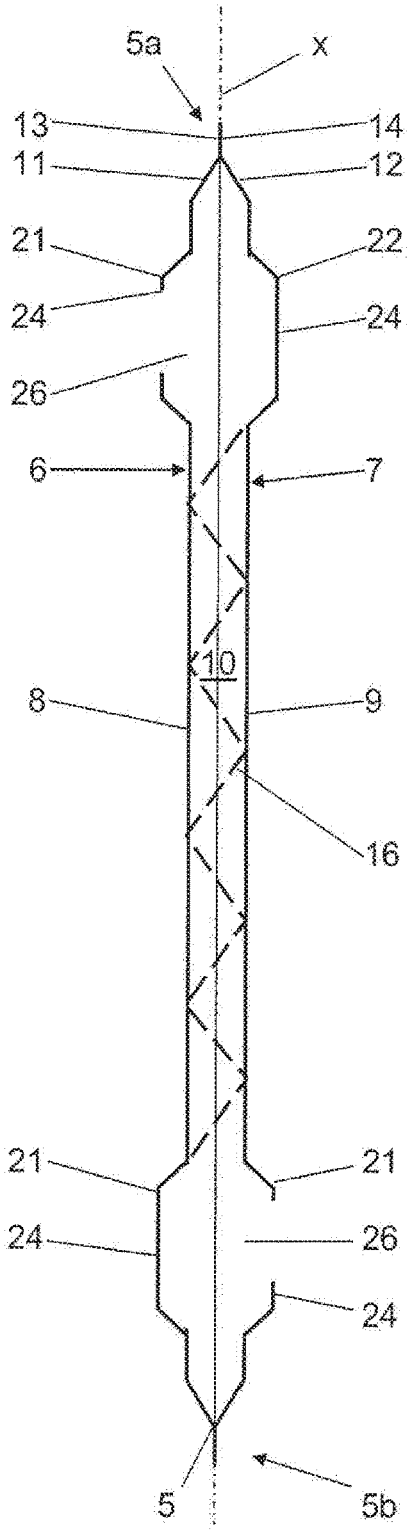
FIG. 5 discloses a side view of a cassette of a heater according to a second embodiment of the invention.

FIG. 5 discloses a cassette 5 of a heater according to a second embodiment, which differs from the first embodiment in that the connecting member comprises a corrugated sheet 16 provided in the flow channel 10 between the first plate 6 and the second plate 7. The corrugation of the corrugated sheet 16 is configured to permit the medium to flow through the flow channel 10 from one of the openings 26 at one end to another of the openings 26 at the other end. Also the corrugated sheet 16 may be permanently joined to the first main surface 8 and the second main surface 9, for instance by means of brazing, bonding, welding or gluing.

Figure 6:
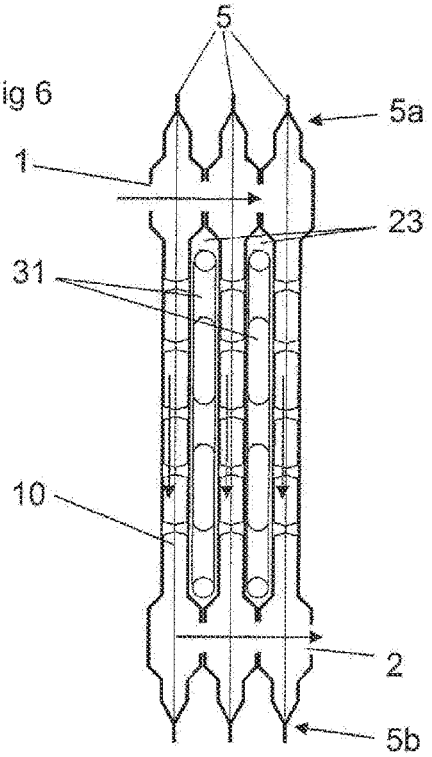
FIG. 6 discloses a schematic side view of a heater according to a third embodiment with three cassettes arranged for a parallel flow of the medium.

FIG. 6 discloses a third embodiment which differs from the first embodiment in that the heater comprises three cassettes in parallel flow through the flow channels 10 of the cassettes 5. The heater comprises two electric heating elements 31 arranged in a respective space 23 between the cassettes 5. The inlet 1 is provided at the first end 5*a* and the outlet 2 is provided at the second end 5*b* on the opposite side of the heater. The connecting member comprises protrusions 15 as in the first embodiment, but could be configured in other ways, for instance with a corrugated sheet 16 as in the second embodiment.

Figure 7:
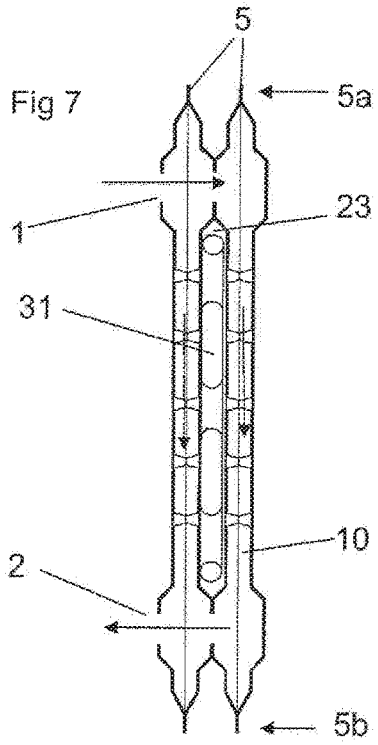
FIG. 7 discloses a schematic side view of a heater according to a fourth embodiment with two cassettes arranged for a parallel flow of the medium.

FIG. 7 discloses a fourth embodiment which differs from the first embodiment in that the medium flows in parallel flow through the flow channels 10 of the two cassettes 5, and in that the inlet 1 and the outlet 2 are provided on the same side of the heater. The connecting member comprises protrusions 15 as in the first embodiment but could be configured in other ways, for instance with a corrugated sheet as in the second embodiment.

Figure 8:
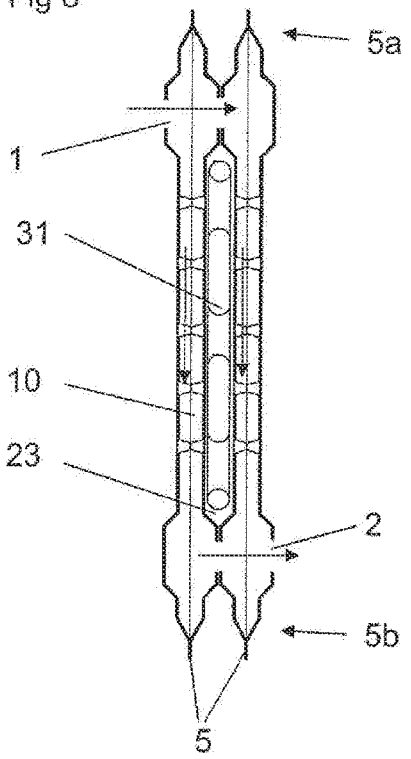
FIG. 8 discloses a schematic side view of a heater according to a fifth embodiment with two cassettes arranged for a parallel flow of the medium.

FIG. 8 discloses a fifth embodiment which differs from the first embodiment in that the medium flows in parallel flow through the two cassettes and in that the inlet 1 is provided at the first end 5*a* and the outlet 2 is provided at the second end 5*b* on the opposite side of the heater. The connecting member comprises protrusions 15 as in the first embodiment, but could be configured in other ways, for instance with a corrugated sheet 16 as in the second embodiment.

Figure 9:
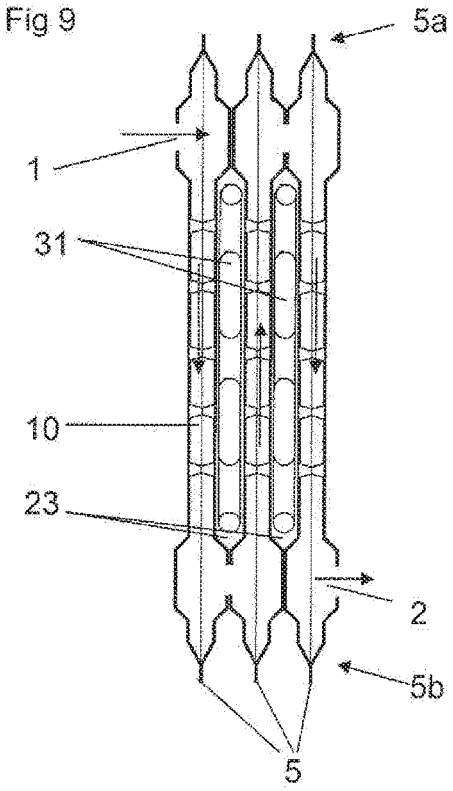
FIG. 9 discloses a schematic side view of a heater according to a sixth embodiment with three cassettes arranged for a serial flow of the medium.

FIG. 9 discloses a sixth embodiment which differs from the first embodiment in that the heater comprises three cassettes. The heater comprises two electric heating elements 31 arranged in a respective space 23 between the cassettes 5. As in the first embodiment, the medium flows in serial flow through the flow channels 10. The inlet 1 is provided at the first end 5*a* and the outlet 2 is provided at the second end 5*b* on the opposite side of the heater. The connecting member comprises protrusions 15 as in the first embodiment but could be configured in other ways, for instance with a corrugated sheet as in the second embodiment.

Figure 10:
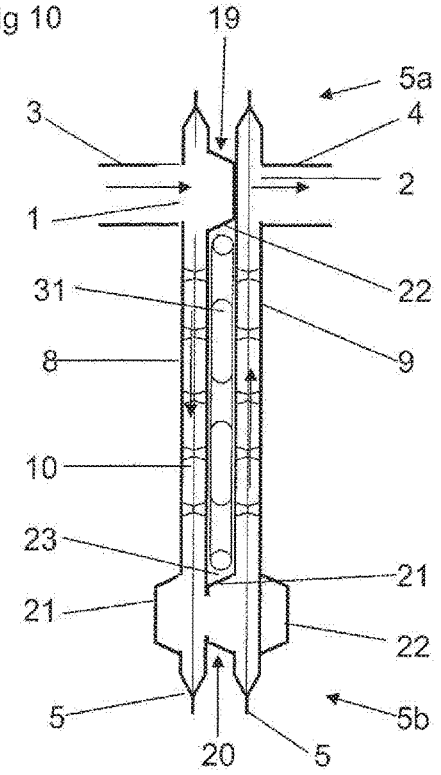
FIG. 10 discloses a schematic side view of a heater according to a seventh embodiment with two cassettes arranged for a serial flow of the medium.

FIG. 10 discloses a seventh embodiment which differs from the first embodiment in that each distance member 19 comprises only one projection 21, 22. Each first plate 6 comprises one, or only one, first projection 21 extending from the first main surface 8. Each second plate 7 comprises one, or only one, second projection 22 extending from the second main surface 9. The first and second plates 6, 7 are identical and may be rotated to achieve various configurations regarding the position of the inlet 1 and the outlet 2, for instance as exemplified in FIGS. 6 to 9, and also with respect to parallel or serial flow of the medium. The inlet pipe 3 and the outlet pipe 4 are directly attached to the first main surface 8 and the second main surface 9, respectively.

Figure 11:
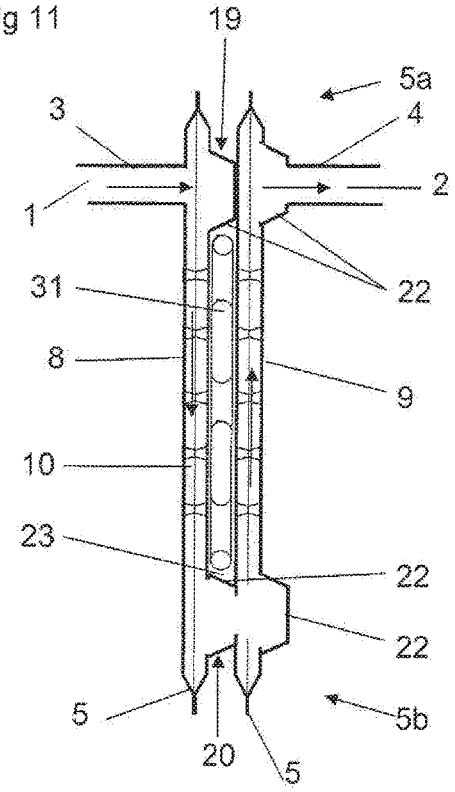
FIG. 11 discloses a schematic side view of a heater according to an eighth embodiment with two cassettes arranged for a serial flow of the medium.

FIG. 11 discloses an eighth embodiment which differs from the first embodiment in that each distance member 19 comprises only one projection 21, 22. Each second plate 7 comprises two second projections 22 extending from the second main surface 9 to the first main surface 8 of the adjacent cassette 5. The first plates 6 comprise no projections. The inlet pipe 3 is attached to the first main surface 8. The outlet pipe 4 is attached to one of the second projections 22.

Figure 12:
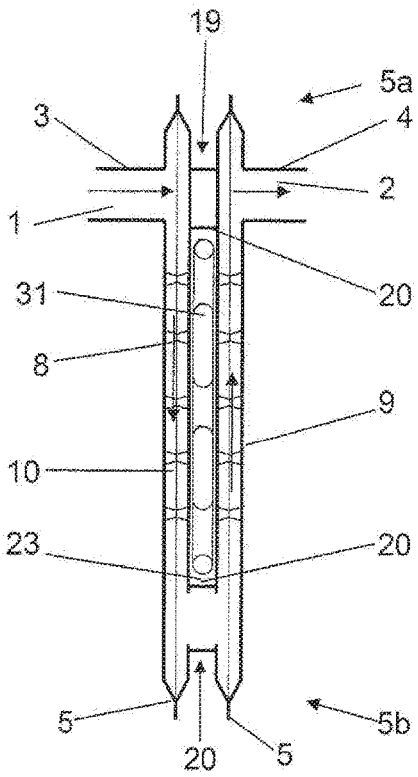
FIG. 12 discloses a schematic side view of a heater according to a ninth embodiment with two cassettes arranged for a serial flow of the medium.

FIG. 12 discloses a ninth embodiment which differs from the first embodiment in that each distance member 19 comprises a ring 20. The first and second plates 6 have no projections, but the ring 20 extends from the second main surface 9 of one of the cassettes 5 to the first main surface 8 of the adjacent cassette 5. Each ring 20 defines two planar joining areas 24 abutting and joined to the second main surface 9 of one of the cassettes 5 and the first main surface 8 of the adjacent cassette 5. The first and second plates 6, 7 are identical except for the positions and number of openings 26. The inlet pipe 3 and the outlet pipe 4 are directly attached to the first main surface 8 and the second main surface 9, respectively.

The present invention is not limited to the embodiments disclosed but may be varied and modified within the scope of the following claims.

It is to be noted that further configurations of the heater are possible, for instance 4, 5, 6 or even more cassettes 5 arranged to permit the medium to flow in parallel flow or serial flow.

Furthermore, at least the first and second plates 6 and 7 that face each other in the heater may have projecting members extending outwardly into the space 23 from the planar first main surface 8 and the planar second main surface 9, respectively. Such projecting members may facilitate the positioning of the electric heating element 31 during the joining of the heater.

It is also to be noted that the cassettes 5 and the electric heating element 31 may be joined together by means of tie bolts, as an alternative to the permanent joining discussed above. The first and second plates 6 and 7 and the connecting member between the plates are still permanently joined as described above.

The invention claimed is:

1. A heater comprising an inlet for a medium to be heated, an outlet for the medium, at least two cassettes, each cassette comprising a first plate comprising a first main surface and a second plate comprising a second main surface, wherein the first plate and the second plate are permanently joined to each other and enclose a respective flow channel for the medium between the first and second plates, and wherein the cassettes are arranged beside each other with a space between the cassettes, an electric heating element provided in the space between the cassettes, wherein the electric heating element abuts the first main surface of one of the cassettes and the second main surface of the adjacent cassette, the electric heating element being an elongated heating element that extends along a circuitous path in the space between the cassettes, two distance members extending between said one cassette and said adjacent cassette, wherein the distance members define said space, and the first and second main surfaces of each cassette being permanently connected to one another by way of a plurality of depressions extending inwardly from at least the first main surface of the first plate of the cassette toward the second main surface of the respective cassette, the plurality of depressions being positioned in the flow channel and being spaced apart from one another.

2. A heater according to claim 1, wherein each cassette comprises at least two openings permitting a flow of the medium from the flow channel of said one cassette to the flow channel of said adjacent cassette.

3. A heater according to claim 2, wherein at least one of the openings of said one cassette is provided opposite to one of the openings of said adjacent cassette and wherein the distance members surround said openings and permit said flow through said openings.

4. A heater according to claim 1, wherein each distance member comprises a ring defining two planar joining areas abutting the second main surface of said one cassette and the first main surface of said adjacent cassette.

5. A heater according to claim 1, wherein each distance member comprises at least one projection extending from the second main surface of said one cassette and from the first main surface of said adjacent cassette.

6. A heater according to claim 5, wherein each distance member comprises one projection extending from the second main surface or from the first main surface, and wherein each projection comprises a planar joining area abutting the first main surface or the second main surface of an adjacent cassette.

7. A heater according to claim 5, wherein each distance member comprises a first projection and a second projection, wherein the second plate of said one cassette comprises two second projections, which extend outwardly from the second main surface, and the first plate of said another adjacent cassette comprises two first projections, which extend outwardly from the first main surface, and wherein the first projections of said one cassette are abutting the second projections of said adjacent cassette to define said space.

8. A heater according to claim 7, wherein each of the first and second projections comprises a planar joining area, and the planar joining areas of the second projections of said one cassette are abutting the planar joining areas of the first projections of said adjacent cassette of the heater.

9. A heater according to claim 1, wherein the inlet is in flow communication with the flow channels of the cassettes, and the outlet is in flow communication with the flow channels of the cassettes, so that the heater permits the medium to flow into the inlet, through the flow channels and out through the outlet.

10. A heater according to claim 1, wherein the first main surface and the second main surface are substantially planar.

11. A heater according to claim 1, wherein each first plate comprises a first flange extending around the first plate and away from the first main surface, each second plate comprises a second flange extending around the second plate and away from the second main surface, and the first plate and the second plate are joined to each other by means of a joint extending along an outer edge of the first flange and an outer edge of the second flange.

12. A heater according to claim 1, wherein at least one of the depressions extending from the first main surface abuts a depression extending from the second main surface.

13. A heater according to claim 1, wherein the electric heating element comprises an electrical resistance wire.

14. A heat exchanger installation comprising a heat exchanger and a heater according to claim 1.

15. A heater according to claim 1, wherein each distance member comprises at least one projection extending from the second main surface of said one cassette or from the first main surface of said adjacent cassette.

16. A heater comprising an inlet for a medium to be heated, an outlet for the medium, at least two cassettes, each cassette comprising a first plate comprising a first main surface and a second plate comprising a second main surface, wherein the first plate and the second plate are permanently joined to each other and enclose a respective flow channel for the medium between the first and second plates, and wherein the cassettes are arranged beside each other with a space between the cassettes, an electric heating element in the space between the cassettes, the electric heating element abutting the first main surface of one of the cassettes and the second main surface of the adjacent cassette, the electric heating element including opposite ends connectable to a current source and winding back and forth within the space so that portions of the electric heating element between the opposite ends are spaced apart from one another in the space, two distance members extending between the one cassette and the adjacent cassette, wherein the distance members define the space, the first main surface of the first plate of each cassette being permanently connected to the second main surface of the second plate of the respective cassette by way of at least three depressions extending inwardly from at least the first main surface of the first plate toward the second main surface, the at least three depressions being positioned in the flow channel and being spaced apart from one another, the at least three depressions comprising a first depression, a second depression and a third depression, and one of the portions of the electric heating element passing between the first and second depressions as seen in plan view of the first and second cassettes, and another one of the portions of the electric heating element passing between the second and third depressions as seen in plan view of the first and second cassettes.

17. A heater according to claim 16, wherein at least one of the depressions extending from the first main surface abuts a depression extending from the second main surface.

18. A heater according to claim 16, wherein the first main surface is permanently connected to the second main surface by way of a plurality of depressions extending inwardly from the second main surface of the second plate toward the first main surface.

19. A heater according to claim 16, wherein each cassette comprises at least two openings permitting a flow of the medium from the flow channel of said one cassette to the flow channel of said adjacent cassette.

* * * * *